US012011798B2

(12) United States Patent
Chiocchetti et al.

(10) Patent No.: US 12,011,798 B2
(45) Date of Patent: Jun. 18, 2024

(54) GRINDING UNIT FOR A CUTTING BLADE, MACHINE COMPRISING SAID UNIT AND RELATED METHOD

(71) Applicant: Fabio Perini S.p.A., Lucca (IT)

(72) Inventors: Mario Gioni Chiocchetti, Capannori (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 1194 days.

(21) Appl. No.: 16/630,597

(22) PCT Filed: Jul. 16, 2018

(86) PCT No.: PCT/IB2018/055231
§ 371 (c)(1),
(2) Date: Jan. 13, 2020

(87) PCT Pub. No.: WO2019/016666
PCT Pub. Date: Jan. 24, 2019

(65) Prior Publication Data

US 2020/0171615 A1 Jun. 4, 2020

(30) Foreign Application Priority Data

Jul. 18, 2017 (IT) ..... 102017000081306

(51) Int. Cl.
*B24B 3/46* (2006.01)

(52) U.S. Cl.
CPC ..... *B24B 3/46* (2013.01)

(58) Field of Classification Search
CPC .. B26D 7/12; B24B 3/46; B24B 3/463; B24B 27/0076
See application file for complete search history.

(56) References Cited

U.S. PATENT DOCUMENTS 4,584,917 A * 4/1986 Blom ..... B26D 7/12 451/21
6,224,468 B1 * 5/2001 Blume ..... B26D 7/12 451/48

(Continued)

FOREIGN PATENT DOCUMENTS

CN 103640045 A 3/2014
CN 103112037 B 9/2015

(Continued)

*Primary Examiner* — Joel D Crandall
(74) *Attorney, Agent, or Firm* — Breiner & Breiner, L.L.C.

(57) ABSTRACT

The grinding unit includes a slide provided with a movement towards and away from the disc-shaped cutting blade. On the slide, at least a first grinding wheel and a second grinding wheel are arranged so as to act on a first flank and on a second flank of a cutting edge of the disc-shaped cutting blade. The first grinding wheel and the second grinding wheel are respectively carried by a first arm and by a second arm that are mounted so as to rotate around a respective rotation axis with respect to the slide (115) in order to move towards and away from the disc-shaped cutting blade. The first arm and the second arm are associated with angular locking members adapted to lock the first arm and the second arm in a respective operative angular position with respect to the slide.

24 Claims, 10 Drawing Sheets

(56) References Cited

U.S. PATENT DOCUMENTS

| | | | | |
|---|---|---|---|---|
| 8,136,434 | B2 * | 3/2012 | Casella | B23D 59/001 83/62.1 |
| 9,393,662 | B2 * | 7/2016 | Schroeder | B24B 3/40 |
| 2006/0000312 | A1 | 1/2006 | Chiocchetti et al. | |
| 2006/0011015 | A1 * | 1/2006 | Chiocchetti | B24B 3/368 76/81.7 |
| 2006/0162522 | A1 | 7/2006 | Chiocchetti et al. | |
| 2012/0184186 | A1 | 7/2012 | Graham, Jr. et al. | |
| 2014/0273761 | A1 * | 9/2014 | Arndt | B24B 3/36 451/48 |

FOREIGN PATENT DOCUMENTS

| | | | |
|---|---|---|---|
| EP | 2196294 | A1 | 6/2010 |
| EP | 2239111 | A1 | 10/2010 |
| EP | 2878413 | A1 | 6/2015 |
| WO | 0136151 | A1 | 5/2001 |
| WO | 2015079464 | A1 | 6/2015 |
| WO | 2015083188 | A1 | 6/2015 |
| WO | 2016030124 | A1 | 3/2016 |
| WO | 2016030125 | A1 | 3/2016 |

* cited by examiner

GRINDING UNIT FOR A CUTTING BLADE, MACHINE COMPRISING SAID UNIT AND RELATED METHOD

TECHNICAL FIELD

Cutting machines and methods are disclosed for cutting rolls or so-called logs of wound paper, for instance tissue paper, for producing rolls of toilet paper, kitchen towels and the like. Grinding units are also disclosed for grinding blades of cutting machines.

STATE OF THE ART

In many industrial fields rolls or logs of a continuous web material are produced, and then divided, by means of so-called cutting machines, into a plurality of logs of smaller axial dimensions. Typically, in the production of tissue paper rolls, for example rolls of toilet paper, kitchen towels and the like, a reel of large diameter (so-called parent reel) is processed into a plurality of rolls or logs, whose axial length is equal to the axial length of the parent reel and whose diameter is equal to the diameter of the rolls to be packed and sold to the end user. The logs are cut into a plurality of rolls by means of cutting machines, usually provided with one or more disc-shaped rotating blades.

The cutting machines are usually provided with one or more disc-shaped rotating cutting blades that are subject to wear and shall be therefore periodically ground. To this end, the cutting machines usually comprise grinding units for each blade. The grinding units usually comprise a pair of grinding wheels acting on opposite sides of the cutting edge.

Examples of cutting machines for cutting tissue paper logs and producing rolls, provided with grinding units for grinding the disc-shaped cutting blades, are disclosed in US 2006/0011015, WO 20016/030125, US 2006/0162522, US 2006/000312, WO 01/36151, EP 2878413, WO 2015/079464, WO 2015/083188, US 2012/0184186.

The disc-shaped cutting blades gradually wear due to the repeated grinding and shall be therefore periodically replaced. Every time a worn disc-shaped cutting blade is replaced with a new blade, it is necessary to correctly reposition the grinding unit, arranging it in a so-called "zero position". For this operation experienced staff is required; moreover, it is significantly dangerous as it is necessary to access the inside of the cutting machine in the area where the extremely sharp disc-shaped cutting blade is arranged. In this phase, the edge of the blade cannot be protected and it is therefore exposed, with the risk for the operator to be seriously injured. Systems have been studied for automatically resetting the grinding wheels without the need for accessing the inside of the cutting machine. Solutions of this type are disclosed in WO2016/030125.

The zero resetting automatic devices described therein are particularly effective, but they can be improved as regards reliability and cost reduction.

SUMMARY

According to one aspect, a grinding unit for grinding a disc-shaped cutting blade is disclosed, comprising a slide provided with a movement towards and away with respect to the disc-shaped cutting blade. The slide can be movable in radial direction with respect to the rotation axis of the disc-shaped cutting blade. At least a first grinding wheel and a second grinding wheel are arranged on the slide, so as to act on a first flank and on a second flank of a cutting edge of the disc-shaped cutting blade. The first grinding wheel and the second grinding wheel are respectively carried by a first arm and by a second arm that are mounted so as to rotate around a respective rotation axis with respect to the slide, in order to move towards and away from the disc-shaped cutting blade. Moreover, the first arm and the second arm are associated with angular locking members adapted to lock the first arm and the second arm in a respective angular working position with respect to the slide, where each grinding wheel touches the corresponding flank of the disc-shaped cutting blade.

In advantageous embodiments, the arms and the grinding wheels are so mounted on the slide that, when the arm is not locked by the angular locking members, the gravity causes a rotation of the arm until the respective grinding wheel contacts the corresponding flank of the cutting edge of the disc-shaped cutting blade.

In this way, by arranging the slide in an initial position, spaced from the rotation axis of the disc-shaped cutting blade, with the grinding wheels arranged on opposite sides with respect to the cutting plane, i.e. to the plane where the cutting edge of the disc-shaped cutting blade lies, it is possible angularly to release the arms supporting the grinding wheels, so that, due to gravity, the wheels move towards against the two side flanks of the cutting edge. This is the working position, where the grinding wheels shall be locked with respect to the slide carrying them.

In practical embodiments, the rotation axis of each arm is orthogonal to a plane containing the rotation axis of the respective grinding wheel.

Practically, according to embodiments disclosed herein, the rotation axis of each arm is oriented at 90° with respect to the rotation axis of the respective grinding wheel and oriented at 90° with respect to the rotation axis of the disc-shaped cutting blade.

In some embodiments, the first arm and the second arm are mounted for rotation on a common support shaft having a longitudinal axis forming the rotation axis of the first arm and of the second arm. In other embodiments, the first arm is supported by a first support shaft having a longitudinal axis forming the rotation axis of the first arm; the second arm is supported by a second support shaft having a longitudinal axis forming the rotation axis of the second arm; and the first support shaft and the second support shaft are parallel.

The angular locking members may be provided with a first angular locking actuator for the first arm and with a second angular locking actuator for the second arm. The angular locking members can be pneumatic actuators.

In some embodiments, each arm is associated with an angular lifting device adapted to rotate the respective arm against gravity, in a direction opposite to the rotation direction bringing the respective grinding wheel into contact with the flank of the disc-shaped cutting blade. In this way, the removal of a worn disc-shaped cutting blade and the replacement thereof with a new one are simpler. The angular lifting devices, which can comprise pneumatic, hydraulic or other actuators, push the arms so as to move the respective grinding wheels away from the flanks of the cutting edge of the disc-shaped cutting blade, thus facilitating the removal of this latter.

The grinding unit can comprise only two grinding wheels, so arranged as to act on the two opposite flanks of the cutting edge. However, in other embodiments also four grinding wheels can be used.

For example, a third grinding wheel and a fourth grinding wheel can be provided, so arranged as to act respectively on the first flank and on the second flank of the disc-shaped cutting blade. The third grinding wheel and the fourth grinding wheel can be respectively carried by a third arm and by a fourth arm, mounted so as to rotate around the rotation axis of the first arm and of the second arm respectively, in order to move towards and away from the disc-shaped cutting blade. In some embodiments, the third arm and the fourth arm can be associated with angular locking members adapted to lock the third arm and the fourth arm in a respective operative angular position with respect to the slide.

Preferably, when four grinding wheels are used, they are mounted on two distinct adjacent parallel shafts, whose axes form the pivoting axes of the arms supporting the grinding wheels.

In order to reduce the overall bulk of the grinding unit, if the grinding wheels are four, they can be advantageously opposite two by two, and each pair of opposite grinding wheels one has a cup-like shape, whilst the other wheel has a disc-like shape whose diameter is smaller than that of the cup-shaped grinding wheel, so that the two opposite grinding wheels can partially penetrate each other, i.e. the disc-shaped grinding wheel can be partially housed in the inner volume of the cup-shaped grinding wheel. In this way, the overall bulk of the grinding wheels is reduced.

In some embodiments, at least one, some or all the grinding wheels can be supported idle and driven in rotation due to friction with the disc-shaped cutting blade. The possibility is not excluded that one or more grinding wheels can be motorized.

The position of each grinding wheel can be fixed with respect to the arm carrying it, or adjustable in a direction parallel to the rotation axis of the grinding wheel.

In some embodiments, one or more grinding wheels of the grinding unit can be associated with a thrust actuator, so configured and arranged to push the respective grinding wheel in a direction parallel to the rotation axis of the grinding wheel against the cutting edge of the disc-shaped cutting blade.

According to a further aspect, a cutting machine is also disclosed for cutting elongated products, for example tissue paper logs, comprising at least one disc-shaped cutting blade and one grinding unit as described above.

The cutting machine may comprise at least one feed path for products to be cut. The disc-shaped cutting blade and the grinding unit can be supported by a unit provided with a cyclic movement for performing subsequent cuts of the products moving forwards along the feed path. The cyclic movement can be a circular movement, i.e. orbital, an elliptical movement, a reciprocating movement or any other movement suitable for repeatedly cutting the logs.

A cutting machine provided with two disc-shaped cutting blades, angularly and axially offset with respect to each other, will be described below. This is a possible embodiment of the cutting machine incorporating a grinding unit as disclosed herein. A cutting machine of this type has particular advantages as regards the cut operations. However, it should be understood that the features of the grinding unit described herein can be advantageously exploited also in other cutting machines, comprising for example only one disc-shaped cutting blade, or more than two disc-shaped cutting blades, even arranged differently from how described below.

According to a further aspect, a method is disclosed for operating a cutting machine comprising at least a disc-shaped cutting blade with a rotation axis and a grinding unit, wherein the grinding unit comprises at least a first grinding wheel and a second grinding wheel, so arranged as to act on a first flank and on a second flank of a cutting edge of the disc-shaped cutting blade. The method may comprise the following steps:

- supporting the first grinding wheel and the second grinding wheel by means of a first arm and a second arm, each arm rotating around a respective rotation axis;
- moving the first grinding wheel and the second grinding wheel towards the disc-shaped cutting blade arranging the first grinding wheel and the second grinding wheel on opposite sides of the disc-shaped cutting blade, with the rotation axis of the first arm and of the second arm arranged above the disc-shaped cutting blade;
- while supporting the first arm and the second arm idle with respect to the rotation axis of the arms, moving the first grinding wheel and the second grinding wheel, by gravity, towards the first flank and the second flank of the cutting edge;
- when the first grinding wheel and the second grinding wheel are in contact with the first flank and the second flank of the cutting edge, angularly locking the first grinding wheel and the second grinding wheel with respect to the rotation axis of the first arm and of the second arm.

In some embodiments, the method may further comprise the steps of:

- rotating the disc-shaped cutting blade around the rotation axis of the disc-shaped cutting blade;
- cyclically moving the disc-shaped cutting blade along a cutting trajectory and cutting elongated products that are moving forwards along a feed path by means of the disc-shaped cutting blade;
- cyclically moving the grinding wheels towards the cutting edge of the disc-shaped cutting blade in order to grind the disc-shaped cutting blade.

The step of cyclically moving the grinding wheels towards the cutting edge of the disc-shaped cutting blade may comprise the step of moving the grinding wheels in a direction substantially radial with respect to the cutting edge. The approach movement can be controlled so as to recover the wear of the disc-shaped cutting blade caused by grinding. Essentially, at every approach movement, the radial stroke of the grinding unit is greater than the stroke performed in the previous grinding cycle.

BRIEF DESCRIPTION OF THE DRAWINGS

The invention shall be better understood by following the description and the accompanying drawing, which show a non-limiting example of embodiment of the invention. More in particular, in the drawing.

DETAILED DESCRIPTION OF EMBODIMENTS

The detailed description below of exemplary embodiments is made with reference to the attached drawing. The same reference numbers in different drawings identify equal or similar elements. Moreover, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

In the description below, specific reference will be made to a cutting machine for cutting logs of tissue paper for forming rolls of toilet paper, kitchen towels and the like. Features described herein can be advantageously used also for producing cutting machine for cutting other products, where similar problems can occur.

Moreover, the cutting machine described below has some particular features related to the number and the arrangement of the disc-shaped cutting blades. These features are advantageous for some aspects related to the cut of logs or other elongated products, but it should be understood that the grinding units described below can be also used on cutting machines having different arrangements of the disc-shaped cutting blades and of the unit supporting them and giving them the cyclic cutting motion. For example, the cutting machine may have only one disc-shaped cutting blade, or more than two disc-shaped cutting blades, arranged differently from what illustrated in the attached drawing. A grinding unit according to one embodiment described herein can be associated with the or with each disc-shaped cutting blade with which the cutting machine is provided.

Figure 1:
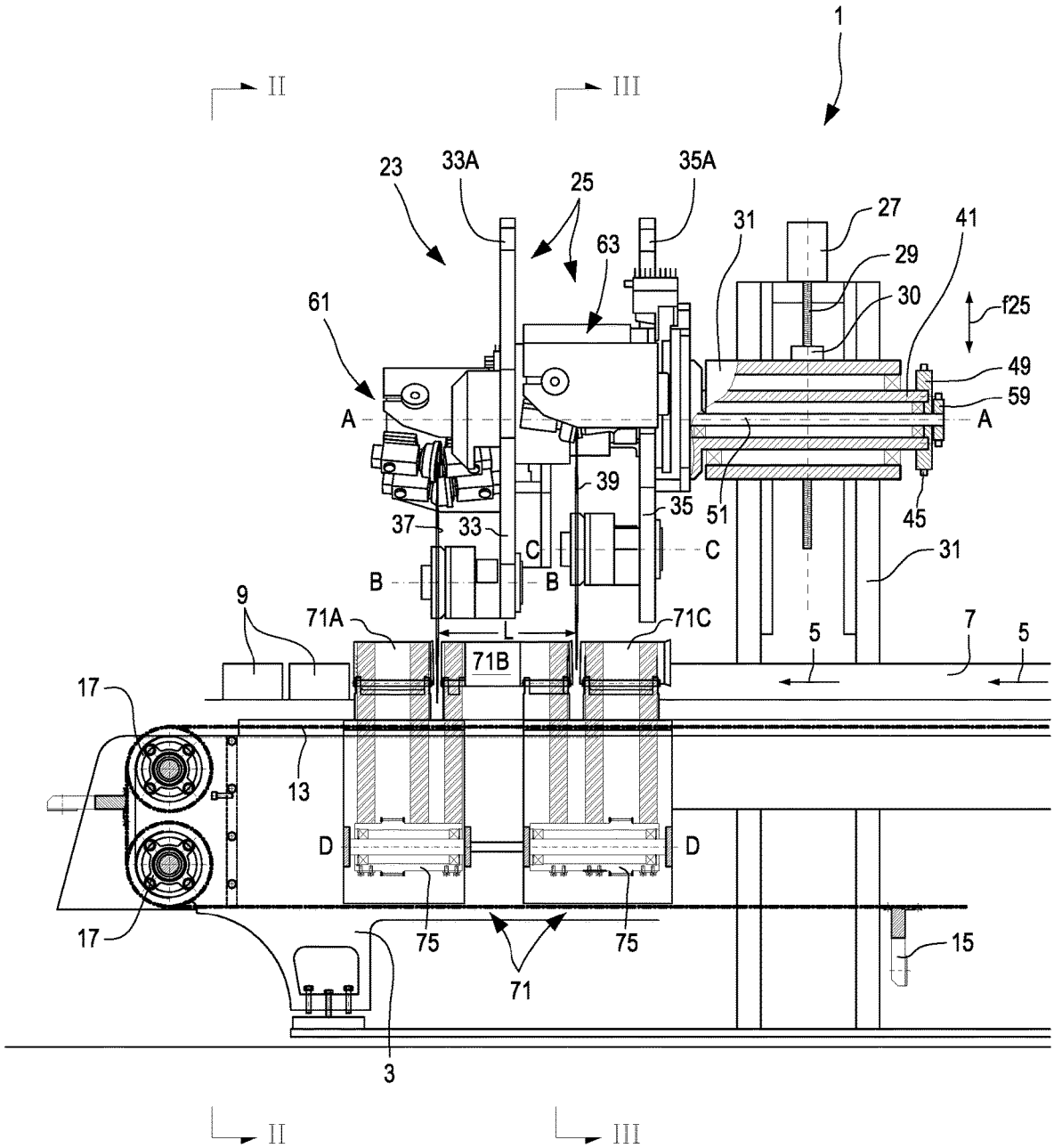
FIG. 1 is a side view and partial cross-section of a cutting machine according to an embodiment.

In FIG. 1 a cutting machine 1 is partially shown. In the illustrated embodiment, the cutting machine 1 comprises a bearing structure 3, on which a feed path 5 for the products to be cut is provided. A product to be cut 7, for example a log of tissue paper or the like, is divided into single rolls 9 that are then moved towards a station where the head and tail trimming are removed, and then to a packing station, both the stations being not shown. As illustrated in detail in FIG. 2, the feed path 5 actually comprises a plurality of feed channels 11. In the illustrated example, four feed channels 11 are provided, adjacent and substantially parallel to one another.

A feed member for respective logs 7 may be associated with each feed channel 11. In the illustrated embodiment, each feed member comprises a continuous flexible member 13, for example a belt or a chain. Along the continuous flexible member 13 pushing members 15 are provided at suitable distance, to push each log 7 from the back along the feed path 5. Each continuous flexible member 13 is driven around wheels 17, two of which are shown in FIG. 1. In practical embodiments, in the end part of the cutting machine 1, not shown in FIG. 1, two more wheels 17 can be provided for each flexible member 13.

Figure 2:
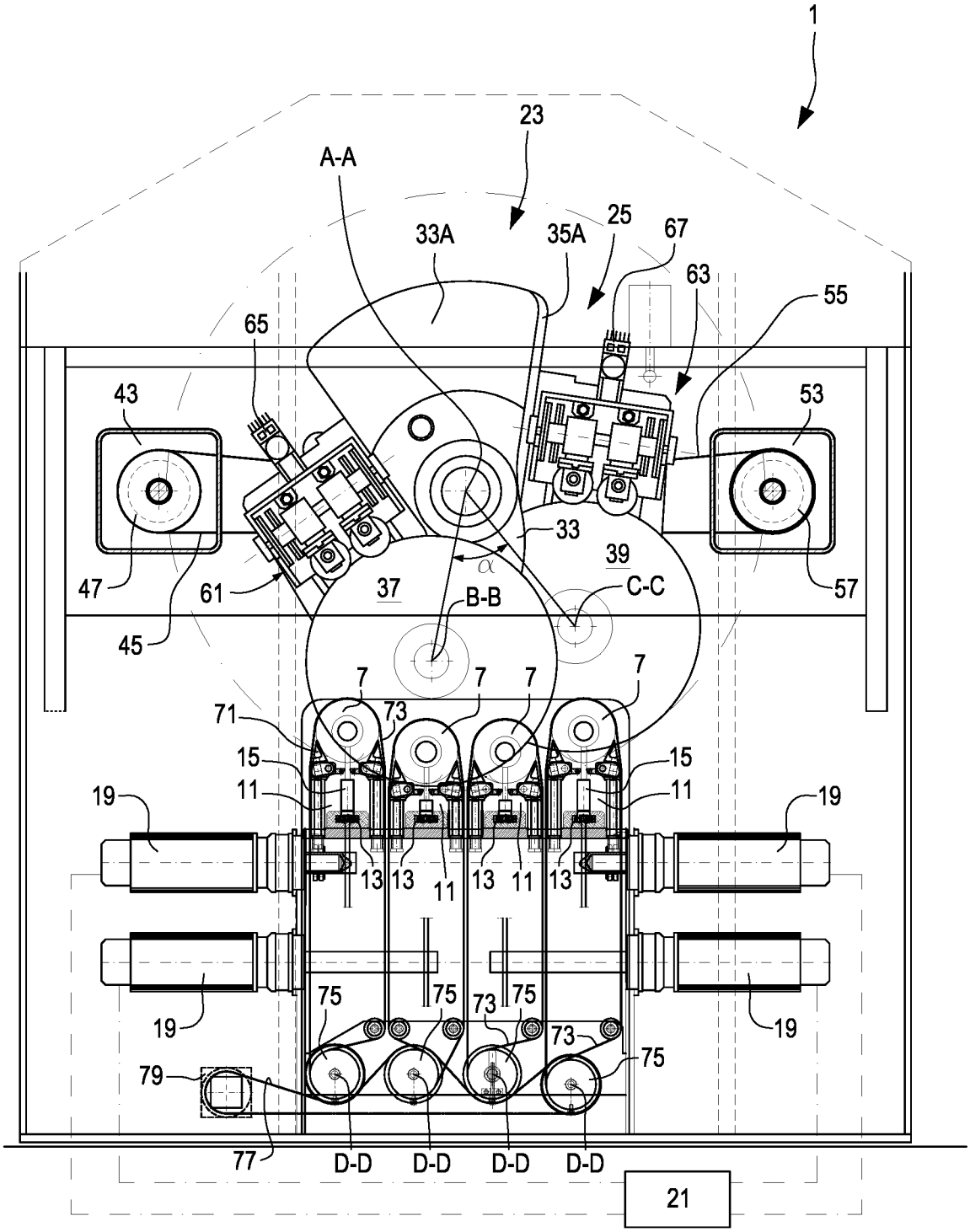
FIG. 2 is a front view according to II-II of FIG. 1.

In some embodiments, each flexible member 13 of each feed channel 11 can be controlled by a respective motor 19 (see FIG. 2). The motors 19 can be controlled by a central control unit, schematically indicated with 21, so as to move forward each log 7 in the respective feed channel 11 with independent motion for the four feed channels 11, for the purposes better explained below.

The cutting machine 1 comprises a cutting head 23 suitably supported by the bearing structure 3, for example by a substantially vertical portion 3.1 of the bearing structure 3. The cutting head 23 can comprise a rotating unit 25 rotating around a rotation axis A-A, which can be substantially horizontal and substantially parallel to the feed path 5 of the logs 7 to be cut. The rotating unit 25 may be movable according to the double arrow f25 in a substantially vertical direction along the portion 3.1 of the bearing structure 3, for the purposes better described below. The motion according to the double arrow f25 allows to move the rotating unit 25 and the rotation axis A-A thereof selectively towards and away from the feed path 5 of the logs 7 to be cut.

The movement according to the double arrow f25 can be controlled by an actuator 27, for example an electric motor, by means of a threaded bar 29 and a nut screw 30. This latter can be integral with a sleeve 31 or other element supporting the rotating unit 25. The upward and downward movement of the rotating unit 25 according to the double arrow f25 can be also imparted by a different moving system, for example by means of a motor and a belt or a chain, a cylinder-piston actuator, a pinion rack mechanism or any other suitable mechanism. The upwards and downward movement of the rotating unit 25 can be preferably controlled by the central control unit 21.

The rotating unit 25 comprises a first arm 33 and a second arm 35. The first arm 33 carries a first disc-shaped cutting blade 37, rotating around a rotation axis B-B. The second arm 35 carries a second disc-shaped cutting blade 39, rotating around a rotation axis C-C. The rotation axes B-B and C-C can be parallel to each other and parallel to the rotation axis A-A of the rotating unit 25.

As shown in particular in FIG. 2, the two disc-shaped cutting blades 37 and 39 are angularly offset with respect to the rotation axis A-A of the rotating unit 25. In FIG. 2, the two disc-shaped cutting blades 37 and 39 are offset by an angle a. In some embodiments, the angle a can be comprised, for example, between 5° and 120°. In embodiments described herein, the angle a is comprised between 10° and 90°. Angles comprised between 15° and 45°, or between 20° and 45° are presently preferred.

As shown in FIG. 1, the first disc-shaped cutting blade 37 and the second disc-shaped cutting blade 39 are offset also in axial direction, i.e. parallel to the rotation axis A-A of the rotating unit 25, and are on two substantially parallel planes, orthogonal to the axes A-A, B-B, C-C and spaced by an adjustable distance L, as described below.

The rotating unit 25 can be driven into rotation by a hollow drive shaft 41, which in turn is driven by a motor 43 through a belt 45 (see FIG. 2). The belt 45 can be driven around a drive pulley 47 actuated by the motor 43 and around a driven pulley 49 keyed on the hollow drive shaft 41 (see FIG. 1).

The hollow drive shaft 41 can be supported inside the sleeve 31 and can be torsionally integral with the rotating unit 25.

Inside the hollow drive shaft 41 a further drive shaft 51 can extend, driven by a second motor 53, for example by a belt 55, driven around a drive pulley 57 and a driven pulley 59. The second drive shaft 51 transmits motion to the first disc-shaped cutting blade 37 and to the second disc-shaped cutting blade 39, for example through toothed belts, chains, gears or other transmission means. A constructive solution for transmitting rotation to the disc-shaped cutting blades 37 and 39 will be described in greater detail below with reference to FIG. 5.

The motorization system of the disc-shaped cutting blades 37 and 39 can be configured differently from what described above, for example providing direct drive motors with the respective shafts 41 and 51 or motors actuating respective output gears engaging toothed gears keyed on the shafts 41 and 51.

In some embodiments, the arms 33 and 35 can be provided with a suitable counter-weights 33A and 35A.

In the present description, the term "arms" 33 and 35 refers to any mechanical structure adapted to support the disc-shaped cutting blades 37 and 39 so as to make them orbit along trajectories centered on the rotation axis A-A.

A grinding unit can be associated with each disc-shaped cutting blade 37, 39. In particular, in FIG. 2 reference number 61 indicates a grinding unit for the disc-shaped cutting blade 37 and reference number 63 indicates a grinding unit for the disc-shaped cutting blade 39. The grinding units 61 and 63 may be provided with a suitable number of grinding wheels, for example two or four grinding wheels for each grinding unit. The grinding units 61 and 63 may also be movable according to a radial direction with respect to the rotation axis of the corresponding disc-shaped cutting blade 37, 39. In this way, each grinding unit 61 and 63 can be brought alternatively into a work position, where the grinding wheels are in contact with the respective disc-shaped cutting blade, and into an idle position. The radial movement also allows to recover the wear of the respective disc-shaped cutting blade due to the subsequent grinding operations. Numbers 65 and 67 generically indicate two actuators controlling the radial movement towards and away of the respective grinding unit 61, 63.

According to some embodiments, in the area of the feed path 5 where the first disc-shaped cutting blade 37 and the second disc-shaped cutting blade 39 act, external holding members for the logs 7 to be cut can be provided. The holding members form, as a whole, a holding device 71. The function of the holding device 71 is to hold the logs 7 during cutting, so that the thrust generated by the disc-shaped cutting blades 37 and 39 orthogonally to the axis of the logs 7 do not move the logs outside the feed path 5.

Figure 5:
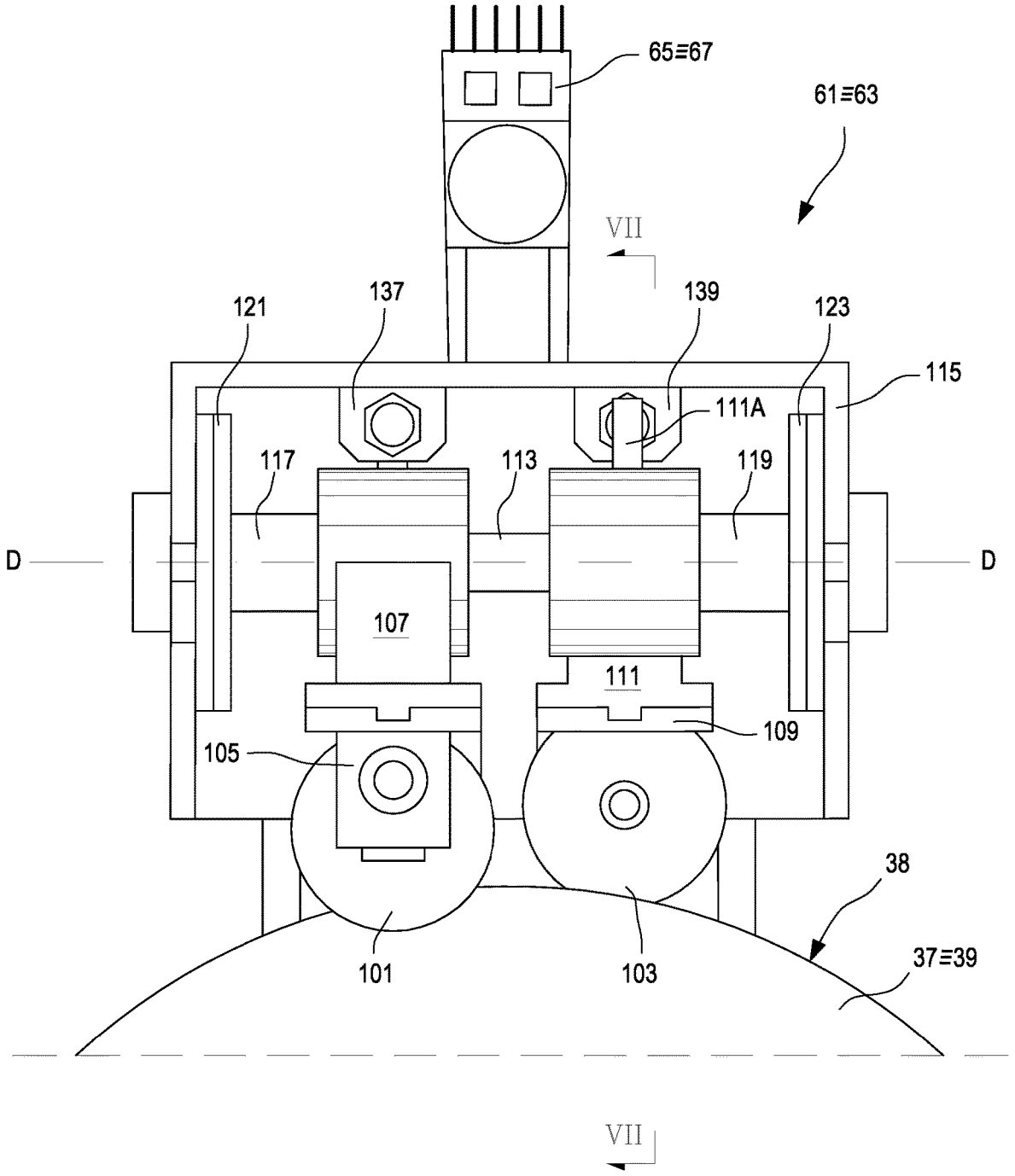
FIG. 5 is a front view of one of the grinding units.

The adjustment of the reciprocal distance in axial direction (i.e. parallel to the axis A-A) of the two disc-shaped cutting blades 37 and 39 may be performed with any suitable system. In FIG. 5 a possible embodiment of the arms 33 and 35 is illustrated, allowing to adjust the reciprocal distance of the arms in axial direction and therefore the reciprocal distance of the disc-shaped cutting blades 37 and 39. It should be understood that this configuration is only one of the possible embodiments of the rotating unit 25.

Figure 4:
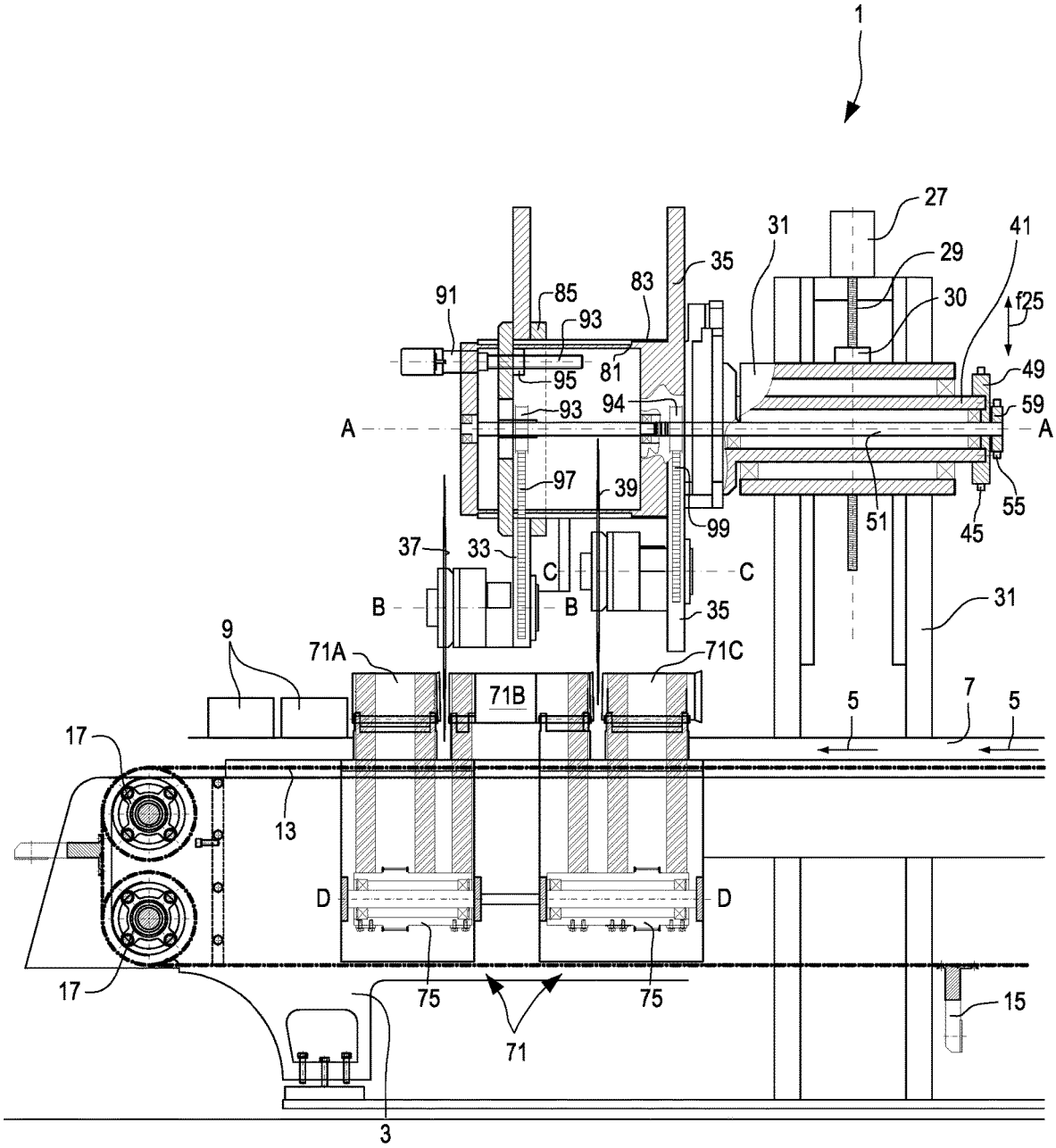
FIG. 4 is a side view and partial cross-section of a variant of embodiment of the cutting machine.

More in particular, in the embodiment of FIG. 4 the arm 35 is integral with the hollow drive shaft 41 and has, on a side opposite the hollow drive shaft 41, a projection 81 with a grooved profile 83, to which a corresponding grooved ring 85 couples, integral with the arm 33. The projection 81 and the ring 85 are torsionally coupled, so that the rotation of the hollow drive shaft 41 is transmitted to both the arm 35 and the arm 33. The grooved profiles meshing together may allow the arm 33 to slide parallel to the axis A-A and, therefore, to adjust the reciprocal distance, in axial direction, of the arms 33 and 35 and consequently the reciprocal distance in axial direction of the disc-shaped cutting blades 37 and 39. The adjustment can be done manually and suitable locking members, for instance screw members, can be provided to lock the arm 33 in the desired axial position along the grooved projection 81. In other embodiments, as illustrated in FIG. 4, an actuator 91 may be provided, for example an electronically controlled electric motor, controlling the rotation of the threaded bar 93 inserted in a nut screw 95 integral with the arm 33. Alternatively, the actuator 91 can be mechanically coupled to the arm 33 by means of any other transmission system, for example a pinion-rack system, or a cylinder-piston actuator can be provided, or any other linear actuator. The actuation of the actuator 91, for example controlled by the central control unit 21, makes the arm 33 translate into the desired position with respect to the arm 35 in the axial direction A-A.

Devices for adjusting the angular offset of the two disc-shaped cutting blades 37 and 39 may be also provided. For example, each of the two disc-shaped cutting blades 37, 39 can be brought by a slide mounted on a respective arm 33, 35, movable along a guide centered with respect to the axis A-A. The slide can be positioned in the suitable position along the guide, and blocked there, for example through a fastening screw system.

FIG. 4 also shows a possible embodiment of the members for transmitting motion from the drive shaft 51 to the disc-shaped cutting blades 37 and 39. In this embodiment, on the drive shaft 51 pulleys 93 and 94 are keyed, around which belts 97 and 99 are driven, which extend along the arms 33 and 35 and are further driven around pulleys (not shown) coaxial with the disc-shaped cutting blades 37 and 39 and torsionally integral therewith. It is also possible to provide the transmission from the shaft 51 to the disc-shaped cutting blades 37 and 39 in a different way, for example with a series of gears, with pairs of conical wheels and a transverse shaft, or in any other adequate manner.

FIGS. 5 to 8 show an embodiment of the grinding units 61 and 63. More in particular, FIG. 5 shows a simplified front view of one of the two grinding units 61, 63. Below, reference will be made mainly to the grinding unit 61, being understood that the description also applies to the grinding unit 63, as the grinding units 61, 63 are substantially equal.

In this embodiment, the grinding unit 61 comprises a first grinding wheel 101 and a second grinding wheel 103. The grinding wheels 101 and 103 are arranged on opposite sides of the cutting edge 38 of the respective disc-shaped cutting blade 37 (or 39).

In the embodiment illustrated in FIGS. 5 to 8, the first grinding wheel 101 is supported rotatable in a support 105, which is in turn constraint to an arm 107 that can rotate around an axis D-D. The axis D-D is substantially oriented at 90° with respect to the rotation axis A-A of the rotating unit 25 and to the rotation axis B-B or C-C of the disc-shaped cutting blade 37 or 39.

The grinding wheel 103 is supported rotatable in a support 109 that is in turn constrained to a second arm 111 that can rotate around the axis D-D. In this embodiment, the axis D-D is constituted by the longitudinal axis of a shaft or beam 113 that can be constrained to a slide 115. The shaft or beam 113 is rigidly constrained to the slide 115 and does not rotate around the axis D-D.

In some embodiments, the rotatable arm 107 is rigidly constrained to a sleeve 117 mounted on the shaft 113, whilst the rotatable arm 111 is rigidly constrained to a sleeve 119 also mounted on the shaft 113. The two sleeves 117, 119 can be selectively free to rotate around the axis D-D of the shaft or beam 113, and torsionally locked with respect to the shaft 113. To this end, a first angular locking member 121 is associated with the first sleeve 117 and a second angular locking member 123 is associated with the second sleeve 119. The angular locking members 121, 123 can be pneumatic or hydraulic locking members. In some embodiments, the angular locking members 121, 123 can be pneumatic locking devices of the series Locked-Series Type R, available from ACE StoBdampfer GmbH, Germany.

By actuating and deactivating the angular locking members 121 and 123 it is possible to make the sleeves 117 and 119 selectively constrained to the shaft 113 and therefore to the slide 115, or free to rotate around the axis D-D, for the purposes described below.

Figure 6:
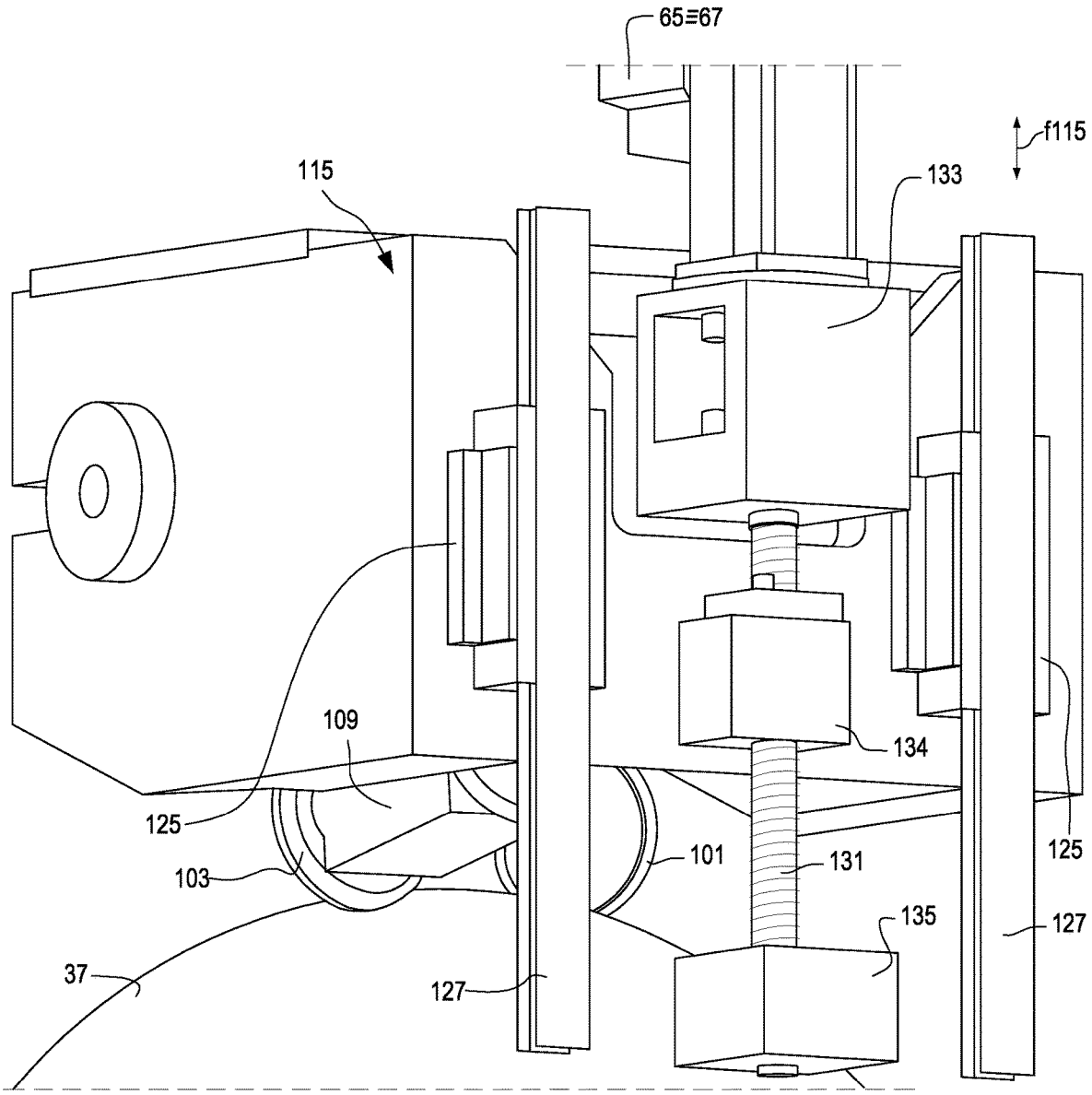
FIG. 6 is a view of one of the grinding units, with some parts removed.

The slide 115 can be mounted slidable on an appendix of the respective arm 33 or 35 carrying the disc-shaped cutting blade 37 or 39. FIG. 6 shows a back view of the slide 115 and of the members through which it is constrained to the respective arm 33 or 35 and is made movable with respect thereto along a direction indicated by the double arrow f115. More in particular, in some embodiments the slide 115 may have shoes 125 integral to the slide 115 that engage guides 127 integral to the arm 33.

The movement of the slide 115 according to the double arrow f115 is controlled by the actuator 65 (or 67) that can interface the central control unit 21. The actuator 65 (or 67) can drive a threaded bar 131 in rotation, on which a nut screw 133 integral to the slide 115 engages. The rotation of the threaded bar 131 in one direction or in the other direction causes the movement of the slide 115 according to the slide f115. Alternatively to the pair threaded bar/nut screw, other motion transmission means can be used, for example a pinion-rack system, a belt, a chain or the like.

Reference numbers 134 and 135 indicate blocks for mounting the actuator 65 and the threaded bar 131 to the arm 33, omitted in FIG. 6 to show the rear part of the slide 115 and the members described above, through which it is guided and moved in the direction f115.

Figure 7:
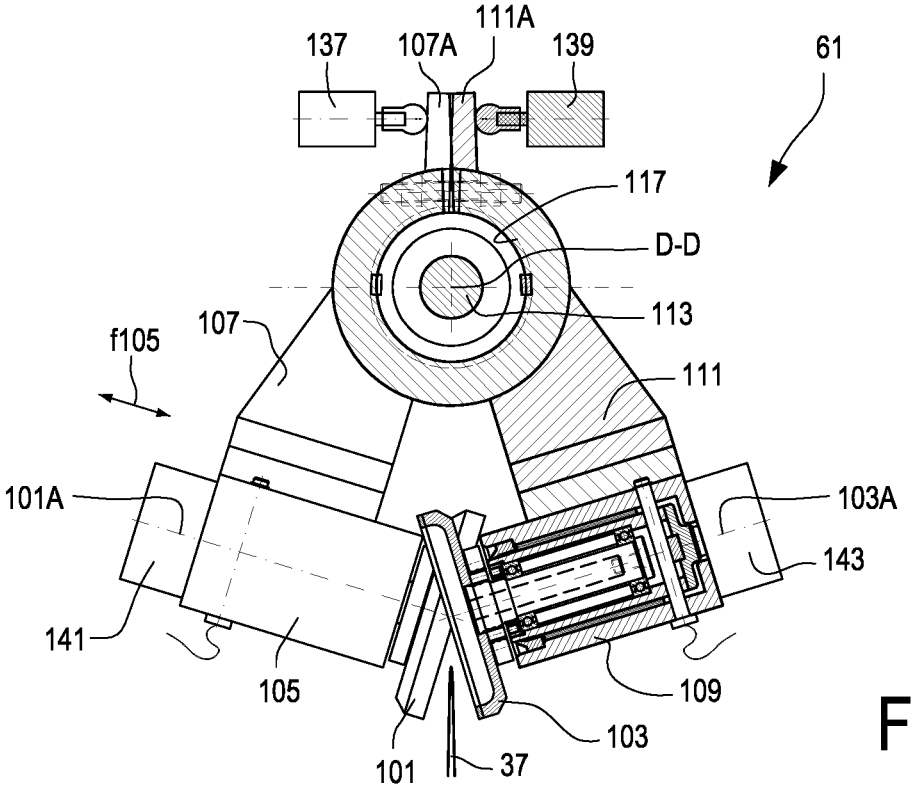
FIGS. 7 and 8 are two cross-sections according to the line VII-VII of FIG. 5 in two different positions of the grinding wheels.
Figure 8:
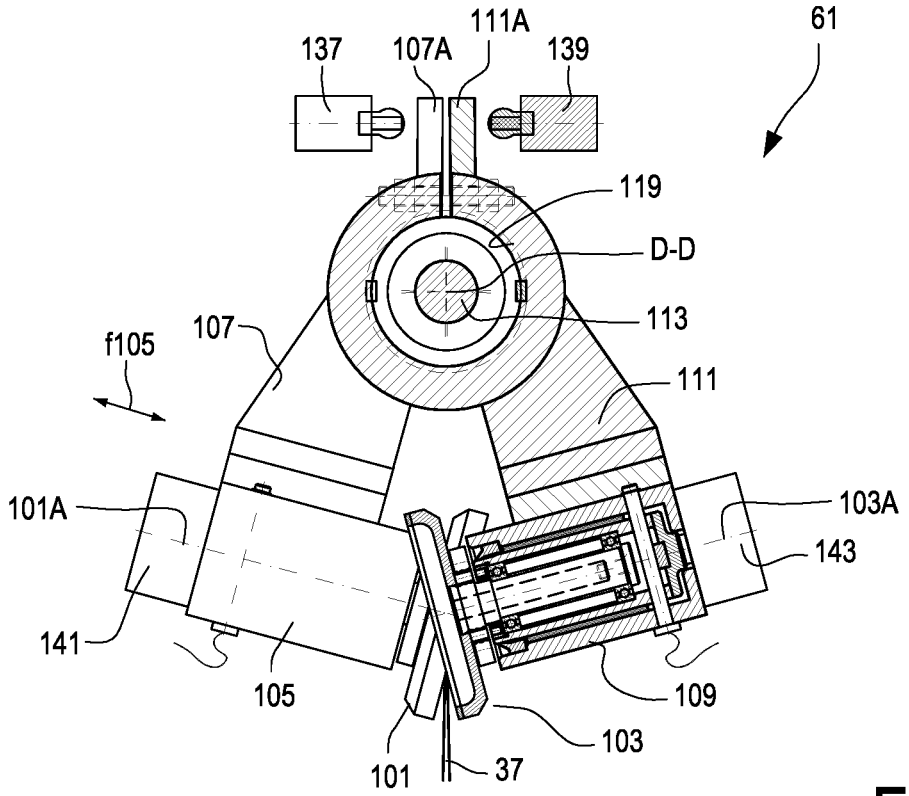

Angular lifting devices 137 and 139 can be integral to the slide 115. The lifting devices can be constituted by cylinder-piston actuators or other actuating devices. The angular lifting device 137 is associated with an appendix 107A of the arm 107, whilst the angular lifting device 139 is associated with an appendix 111A integral to the arm 111. The function of the angular lifting devices 137 and 139 will be explained below with reference to FIGS. 7 and 8, illustrating some features of the grinding unit 61 (or 63) described above. In these figures, only the main elements of the grinding unit are shown, whilst the structure forming the slide 115 has been omitted.

In FIG. 7 a position is shown where the grinding unit 61 (or 63) is in upper position, i.e. at a greater height, with respect to the disc-shaped cutting blade 37 (or 39). The two angular locking members 121 and 123 are inactive, so that the sleeves 117 and 119 can freely rotate around the shaft or beam 113, which is in turn rigidly constraint to the slide 115. The angular lifting devices 137 and 139 are active, i.e. they push the appendixes 107A and 111A of the arms 107 and 111 so as to keep the grinding wheels 101 and 103 spaced from the flanks of the cutting edge 38 of the disc-shaped cutting blade 37. The action of the angular lifting devices 137 and 139 is such to overcome gravity that, acting on the supports 105 and 109 and on the arms 107 and 111, generates a torque tending to rotate the arms 107 and 111, as well as the supports 105 and 109 and the grinding wheels 101 and 103, towards a position where the grinding wheels 101 and 103 rest on two opposite flanks of the cutting edge 38 of the disc-shaped cutting blade 37.

When the angular lifting devices 137 and 139 are disabled, as shown in FIG. 8, as the angular locking members 121 and 123 are disabled, the gravity generates a torque on each arm 107 and 111 causing the rotation of the arms around the axis D-D until to bring the grinding wheels 101 and 103 in the position where they rest against the opposite flanks of the cutting edge 38 of the disc-shaped cutting blade 37, as shown in FIG. 8.

The position of FIG. 8 is the so-called "zero position" that the grinding wheels 101 and 103 shall take for correctly grinding the disc-shaped cutting blades 37, 39. When the cutting machine 1 is provided with a new disc-shaped cutting blade 37, it is necessary to perform an operation of initial positioning of the respective pair of grinding wheels 101, 103 so that they take the right angular initial position (zero position) with respect to the disc-shaped cutting blade 37.

By assuming that a disc-shaped cutting blade 37, 39, is worn and shall be replaced, the following operations can be performed. The respective slide 115 of the corresponding grinding unit 61 or 63 is radially moved away, through the actuator 65, from the rotation axis B-B or C-C of the disc-shaped cutting blade and therefore from the cutting edge 38. Then, the worn disc-shaped cutting blade 37, 39 can be removed by the operator and replaced with a new disc-shaped cutting blade.

Once the new disc-shaped cutting blade 37 or 39 has been mounted on the respective arm 33 or 35, the grinding unit 61, or 63, can be moved radially towards the cutting edge 38 of the new disc-shaped cutting blade 37, achieving the position illustrated in FIG. 7. Before moving the grinding wheels towards the cutting edge 38, the grinding wheels 101 and 103 shall be opened by actuating the lifting devices 137 and 139, so as to bring the grinding wheels 101 and 103 into the angular position of FIG. 7. In order to open the grinding wheels 101 and 103, the angular locking members 121 and 123 have been previously disabled, thus allowing the rotation of the sleeves 117 and 119 around the shaft 113. It is also possible to open the grinding wheels 101 and 103 before removing the worn disc-shaped cutting blade, so as to facilitate the removal thereof.

Now, the lifting devices 137 and 139 can be disabled. Due to gravity, the grinding wheels 101 and 103 rotate around the axis D-D until to rest on the opposite flanks of the cutting edge 38 of the new disc-shaped cutting blade 37, or 39.

The angular position achieved by the grinding wheels 101 and 103 is locked by actuating the angular locking members 121 and 123. Now the cutting machine 1 is ready to be put into operation again.

As it is clearly apparent from the operative sequence described above, the operations performed by the operator inside the cutting machine 1 for replacing a disc-shaped cutting blade 37, or 39, are minimized and in particular it is not necessary that the operator accesses the area near the cutting edge 38 of the disc-shaped cutting blade 37 for the initial positioning of the grinding wheels 101 and 103.

Once the position of FIG. 8 has been achieved, the operation of the grinding unit 61, 63 is substantially equivalent to the operation of a traditional grinding unit.

In the position illustrated in FIG. 8, the grinding wheels 101 and 103 can be pushed in axial direction, i.e. parallel to the respective rotation axes 101A, 103A (to be indicated in the figure), to press with suitable force against the flanks of the cutting edge 38 of the disc-shaped cutting blade 37, or 39. To this end, thrust actuators 141, 143 may be provided. The thrust actuators 141 and 143 can be hydraulic or pneumatic cylinder-piston actuators or simple springs in case the grinding wheels shall be always in working position, for example in the configuration with two grinding wheels. In other embodiments, the grinding wheels can be pushed against the disc-shaped cutting blade by the actuator 67. A combined action of the actuator 67 and the thrust actuators 141, 143 is also possible.

In some embodiments, the actuator 67 can be used to radially move the grinding wheels 101, 103 against the disc-shaped cutting blade and to generate the necessary contact force, whilst the thrust actuators 141, 143 can be used to move the grinding wheels parallel to the axis thereof and to bring them selectively into an active and into an idle position. Practically, during normal operation, the grinding wheels 101, 103 can be brought by the thrust actuators 141, 143 into the active position and kept in this position. Then, the actuator 67 radially moves the grinding unit in order to bring the grinding wheels cyclically into contact with the disc-shaped cutting blade 37 or 39. In some embodiments, instead of thrust actuators 141, 143 pre-load members can be provided, for example elastic members, applying a preferably constant thrust. The pre-load members can be constituted by, or comprise, one or more springs, for example compression springs, such as Belleville springs or helical springs.

In the illustrated embodiment, the grinding wheels 101 and 103 are mounted idle in the respective supports 105 and 109 and therefore they rotate due to friction against the flanks of the cutting edge 38. In some embodiments, not shown, it is also possible to motorize the one or the other or both the grinding wheels 101 and 103

Grinding is done for a set time, for example programmed in the central control unit 21. Once grinding has finished, the slide 115 of the grinding unit 61, 63 can be radially moved away with a movement according to arrow f115 controlled by the actuator 65 or 67. The subsequent grinding cycle can be performed after a set time interval, or after a given number of cuts done by the blade 37, 39, with which the grinding unit 61, 63 is associated. The cutting cycles can be counted by means of the central control unit 21, which can therefore control the actuator 65 so that it performs, at the given time, a new radial approach movement of the slide 115 of the grinding unit 61, or 63, towards the cutting edge 38 of the respective disc-shaped cutting blade 37, or 39.

As grinding causes wear of the disc-shaped cutting blade 37, 39, the movement of the grinding unit towards the disc-shaped cutting blade 37, 39 entails a progressive gradual approach of the grinding unit to the rotation axis B-B, C-C of the corresponding disc-shaped cutting blade 37, 39. Practically, according to embodiments described herein, the central control unit 21 controls a movement of the grinding unit 61, 63 towards the disc-shaped cutting blade 37 and 39 taking into account the progressive reduction in the radial dimension of the disc-shaped cutting blade. At every grinding cycle the actuator 65 moves the grinding unit to the rotation axis of the respective disc-shaped cutting blade by a given step.

Figure 9:
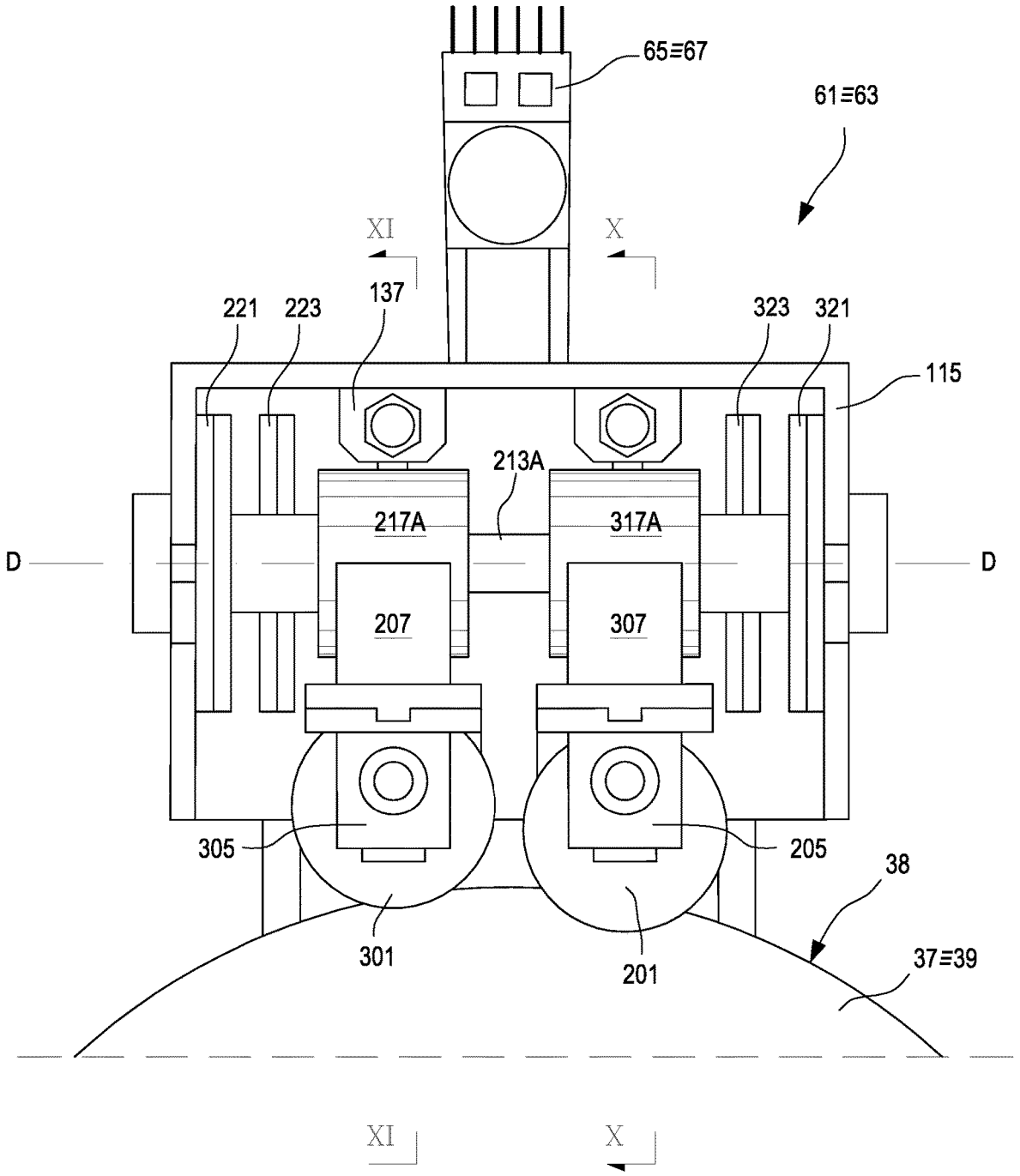
FIG. 9 is a front view of a grinding unit in a further embodiment.
Figure 10:
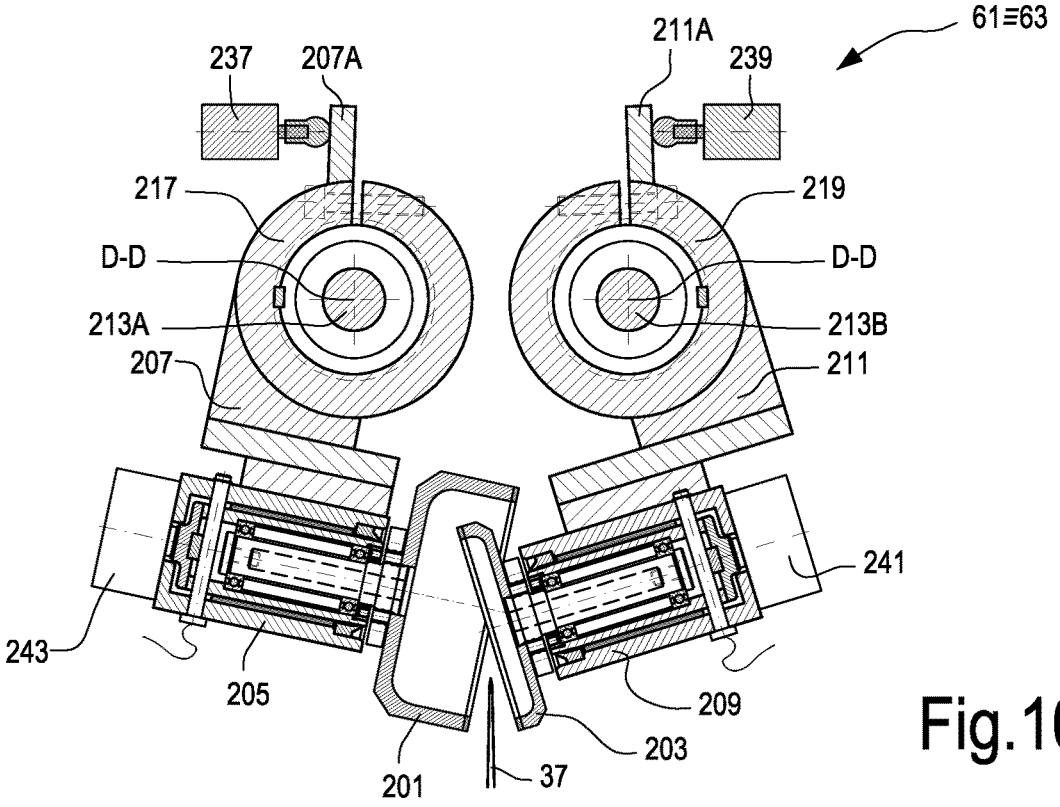
FIGS. 10 and 11 are cross-sections according to the lines X-X and XI-XI of FIG. 9.
Figure 11:
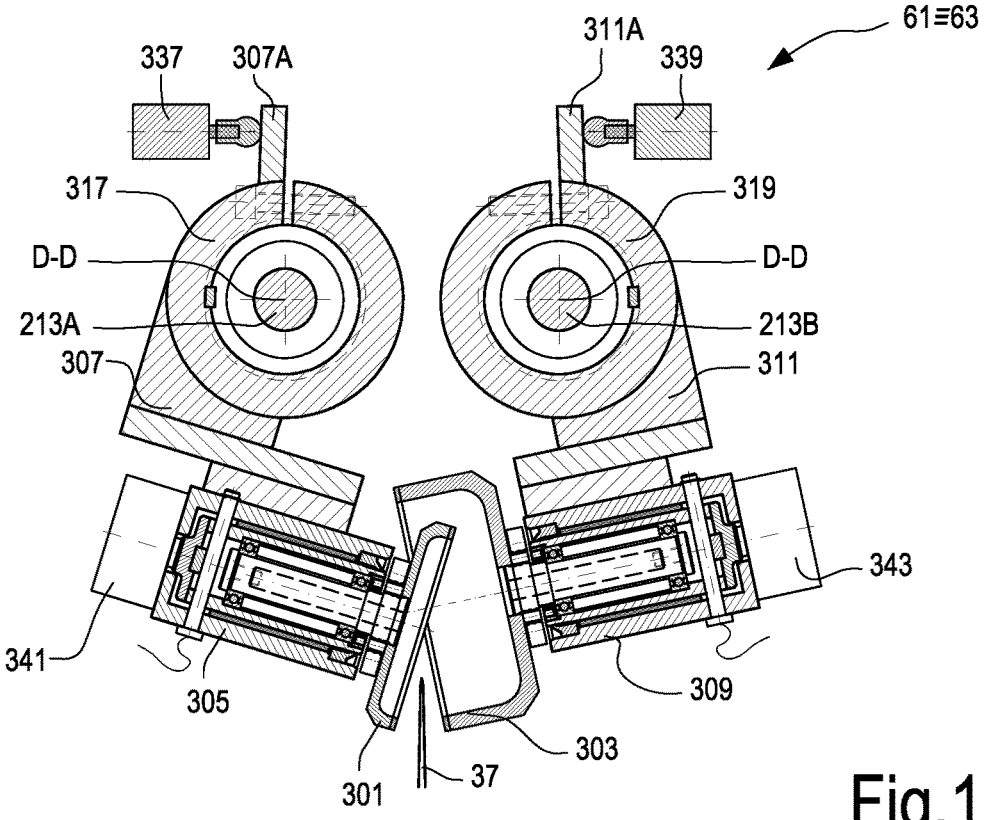

FIGS. 9, 10 and 11 illustrate a further embodiment of the grinding unit 61 or 63. In this embodiment the grinding unit, indicated again as a whole with reference number 61, 63, comprises two pairs of grinding wheels instead of only one pair. The grinding wheels of a first pairs are indicated with 201, 203 and the grinding wheels of a second pairs are indicated with 301, 303.

As shown in particular in the cross-sections of FIGS. 10 and 11, in this case the grinding wheels are supported on two parallel shafts or beams rigidly constraint to the slide 115. The shafts are indicated with 213A and 213B. The grinding wheels 201 and 203 are mounted for rotation on supports 205 and 209, see FIG. 10. In this case again the grinding wheels can be supported idle. 241 and 243 indicate the thrust actuators corresponding to the thrust actuators 141 and 143 of the previous embodiment. 207 and 211 indicate the arms rotating around the shafts 213A and 213B, supporting the grinding wheels 201 and 203, 217 and 219 indicate sleeves equivalent to the sleeves 117 and 119 of the previous embodiment. 207A and 211A indicate the appendices with which angular lifting devices 237 and 239, equivalent to the lifting devices 137, 139 described above, co-act.

The second pair of grinding wheels 301 and 303, shown in particular in the cross-section of FIG. 11, is mounted in equivalent manner on the shafts 213A and 213B. Elements corresponding to those already described with reference to FIG. 10 are indicated by the same reference number increased by "100".

The axes of the shafts 213A and 213B are both indicated with D-D. The sleeves 217 and 219 can be angularly locked on the shafts 213A and 213B through angular locking members 221 and 223 (see in particular FIG. 9). Similarly, the sleeves 317 and 319 can be angularly locked on the shafts 213A and 213B through angular locking members 321 and 323. The angular locking members substantially have the same function as the angular locking members 121 and 123 described with reference to the previous figures.

The grinding unit of FIGS. 9 to 11 substantially operates as the grinding unit described with reference to FIGS. 5 to 8, with the only difference that it has four grinding wheels instead of two.

In order to reduce the space occupied by the grinding wheels 201, 203, 301, 303, as shown in the cross-sections of FIGS. 10 and 11, one of the grinding wheels of each pair has a cup-like shape and a greater diameter than that of the opposite grinding wheel, substantially having a disc-like shape. For example, as shown in FIG. 10, the grinding wheel 201 is cup-shaped whilst the grinding wheel 203 is disc-shaped. In this way, the grinding wheel 203 can be partially housed inside the hollow space defined by the grinding wheel 201. An analogous arrangement, with the grinding wheels inverted, is shown in FIG. 11 for the pair of grinding wheels 301, 303.

With this arrangement with opposite grinding wheels, i.e. wheels acting on opposite flanks of the cutting edge 38, they can be arranged substantially opposite to one another and not offset along the round extension of the disc-shaped cutting blade. This allows mounting, on the same slide 115, two pairs of grinding wheels instead of only one pair, without substantially increasing the bulk thereof.

The angular positioning of the two pairs of grinding wheels 201, 203 and 301, 303 can be done substantially analogously to what described above for the grinding wheels 101 and 103.

The embodiment of FIGS. 9 to 11 provides for two adjacent parallel shafts 213A and 213B, so as to mount the grinding wheels 201, 203 and the opposite grinding wheels 301, 303 in a simpler way. If the grinding unit comprises only two grinding wheels acting on opposite flanks of the disc-shaped cutting blade and arranged offset with respect to each other along the round extension of the cutting edge 38, a single shaft 113 (FIGS. 5 to 8) may be provided, thus reducing the overall number of mechanical members and actuators, in particular of the angular locking members. However, it is also possible to use two parallel shafts also in the case of grinding units with only two grinding wheels.

In all embodiments each support 105, 109, 205, 209, 305, 309 can be adjustable in position with respect to the arm carrying it, with an adjustment movement parallel to the rotation axis of the respective grinding wheel. For example, in FIG. 7 number f105 indicates the adjustment movement of the support 105 with respect to the arm 107. Analogous adjustment movements can be provided for all the supports of the grinding wheels.

By adjusting the support 105 along the arrow f105 it is possible to change the angle at which the grinding wheels 101 and 103 (or 201, 203, 301 and 303) move towards the disc-shaped cutting blade 37 to modify the shape of the cutting edge 38. If the supports 105 are symmetrical, the cutting edge 38 is symmetrical, whilst, if the two supports 105 are adjusted asymmetrically with respect to the median plane of the disc-shaped cutting blade (i.e. to the plane orthogonal to the rotation axis and passing at the center of the thickness of the disc-shaped cutting blade) also the cutting edge 38 will be asymmetrical. The grinding wheels are preferably arranged in a symmetrical manner in order to have a symmetrical cutting edge.

In the arrangement with four grinding wheels shown in FIGS. 10 and 11, it is possible selectively to actuate or disable the thrust actuators 241, 243, 341 and 343 in order to have a grinding configuration with two or four simultaneous grinding wheels. In case of operation with two grinding wheels, the grinding wheels of smaller diameter 203 and 301 can work simultaneously, or the two grinding wheels 201, 303 of greater diameter. The control unit 21 can be programmed in order to control an alternate use of the two pairs of grinding wheels 203, 301 and 201, 303 according to a preset sequence. For example, by suitably programming the thrust actuators 241, 243, 341, 343, one or more consecutive grindings can be performed with the grinding wheels 203, 301 and one or more consecutive grindings can be performed with the grinding wheels 201, 303. In some embodiments, it is possible to perform two grindings with the grinding wheels 203, 301, and one grinding with the grinding wheels 201, 303.

The most suitable grinding sequence is chosen based on the product to be cut, and therefore according to the hardness, diameter, and type of paper of which the products to be cut are made, by using pairs of grinding wheels that can have different grinding features. For example, the pair of grinding wheels 203, 301 can have a grinding feature different than that of the pair of grinding wheels 201, 303. In some embodiments, the two pairs of grinding wheels 203, 301 and 201, 303 may have different size. For example, the grinding wheels 201, 303 can be of a greater size and the grinding wheels 203, 301 a smaller size, or vice versa. In possible embodiments, the pairs of grinding wheels 203, 301 and 203, 301 can differ in other grinding features, for example they can have different hardness, or a different inclination with respect to the disc-shaped cutting blade. The two pairs of grinding wheels 203, 301 and 201, 303 can differ also in more than one grinding feature, for example in both size and inclination. In the present description and the attached claims, grinding feature means in general a feature affecting the effect of the grinding wheel on the disc-shaped cutting blade.

The two grinding wheels of a pair having the same grinding features usually are not opposite to each other; they are namely offset, as mentioned above, for bulk reasons.

By using pairs of grinding wheels of different size it is possible to alternate a grinding with grinding wheels of greater size, in order to have a more incisive grinding action, with a series of finishing grindings with grinding wheels of smaller size. In the sequence with alternating grinding wheels it is also possible to provide grinding with all the grinding wheels 203, 301 and 201, 303. The control unit 21 may have available grinding "recipes", i.e. grinding solutions, that is optimal grinding sequences with two or four grinding wheels and optimal positions of the support 105 based on the product to be cut. The control unit 21 can be so programmed that, when the operator selects the type of product to be produced, the control unit 21 automatically chooses the best grinding solution.

In both the embodiments with two or four grinding wheels, it is possible to arrange the grinding wheels with respect to the cutting edge 38 so that both grinding wheels rotate in entering direction with respect to the disc-shaped cutting blade 37 or 39. This means that, in the contact point between grinding wheel and disc-shaped cutting blade, the vector velocity of the grinding wheel is oriented centripetally, i.e. with a component approximately directed towards the rotation axis of the disc-shaped cutting blade. In this way it is possible to avoid trimmings along the cutting edge 38, projecting outside the same edge.

Figure 12:
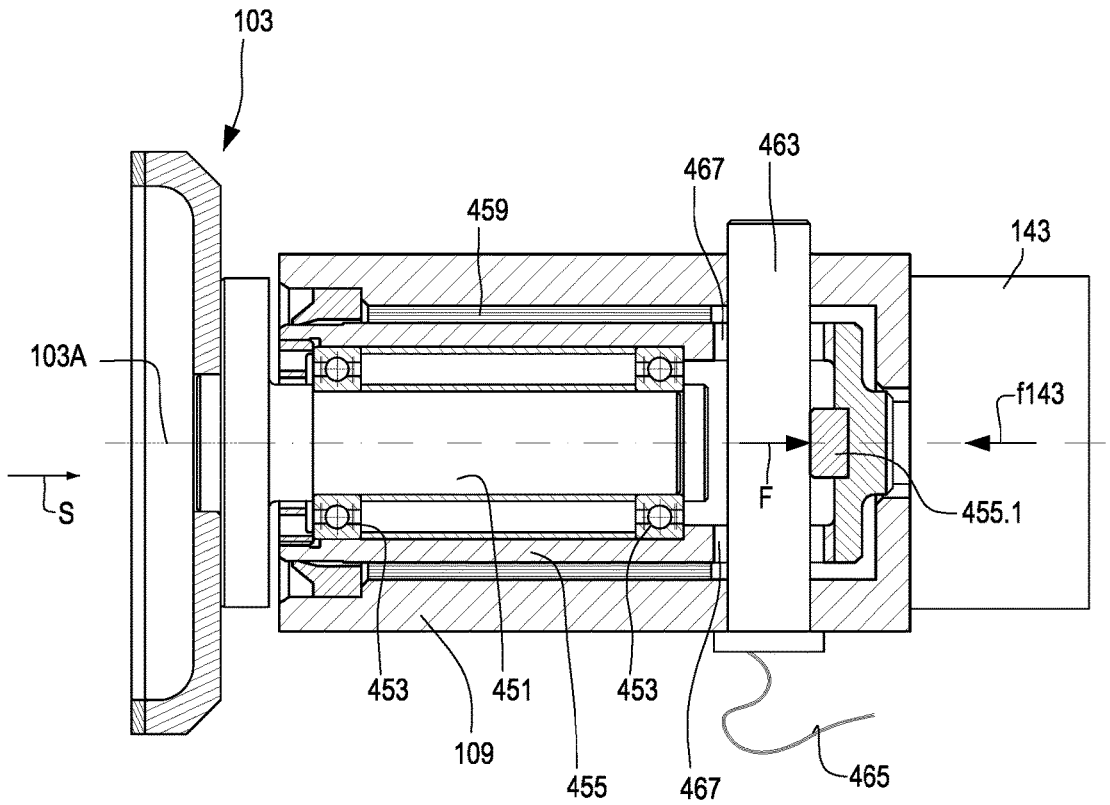
FIG. 12 is a cross-section of one of the grinding wheels and the corresponding support system containing a load cell.

In some embodiments, one or more grinding wheels of one, some or all the grinding units of the cutting machine 1 can be provided with a respective load cell to detect the axial thrust applied onto the grinding wheel. FIG. 12 illustrates a cross-section grinding wheel (in the example the grinding wheel 103) according to a plane containing the rotation axis 103A of the grinding wheel 103. The arrangement shown in FIG. 12 and illustrated below can be used also for the other grinding wheels described above.

In the embodiment illustrated in FIG. 12, the grinding wheel 103 is rigidly mounted on a support shaft 451, whose axis is coincident with the rotation axis 103A of the grinding wheel 103. The shaft 451 can be supported rotatable by means of bearings 453 in a sleeve 455. Advantageously, the shaft 451 can be mounted in the sleeve 455 so as not to translate in axial direction with respect to the sleeve 455, i.e. in a direction parallel to the rotation axis 103A of the grinding wheel 103.

In some embodiments, the sleeve 455 is housed in a casing formed by the support 109 and can translate with respect to the support or casing 109. In some embodiments described herein, a bushing 459 or other bearing can be provided, allowing the sleeve 455 to translate with respect to the casing or support 109 parallel to the rotation axis 103A of the grinding wheel 103.

In the illustrated embodiment, a pre-load member is integral to the casing or support 109, wherein the pre-load member can be constituted, in the illustrated example, by the thrust actuator 143, or by other pre-load members, for example a spring or a combination of springs. In the description below of FIG. 12, the thrust actuator 143 is also called pre-load member. It applies, on the sleeve 455, a thrust parallel to the rotation axis 103A of the grinding wheels 103. The thrust is indicated with the arrow f143 and is directed towards the grinding wheel 103. The overall thrust of the pre-load member 143 may have fixed or variable value, for example the value can be set by the operator.

As detailed below, the pre-load member 143 applies a pre-load on the sleeve 455. If the pre-load member 143 is constituted by an actuator, or comprises an actuator, it can be also used to move the sleeve 455, and therefore the grinding wheel 103, away from the disc-shaped cutting blade 37 or 39. This can be useful, for example, if the grinding unit has more grinding wheels that shall work selectively.

Figure 3:
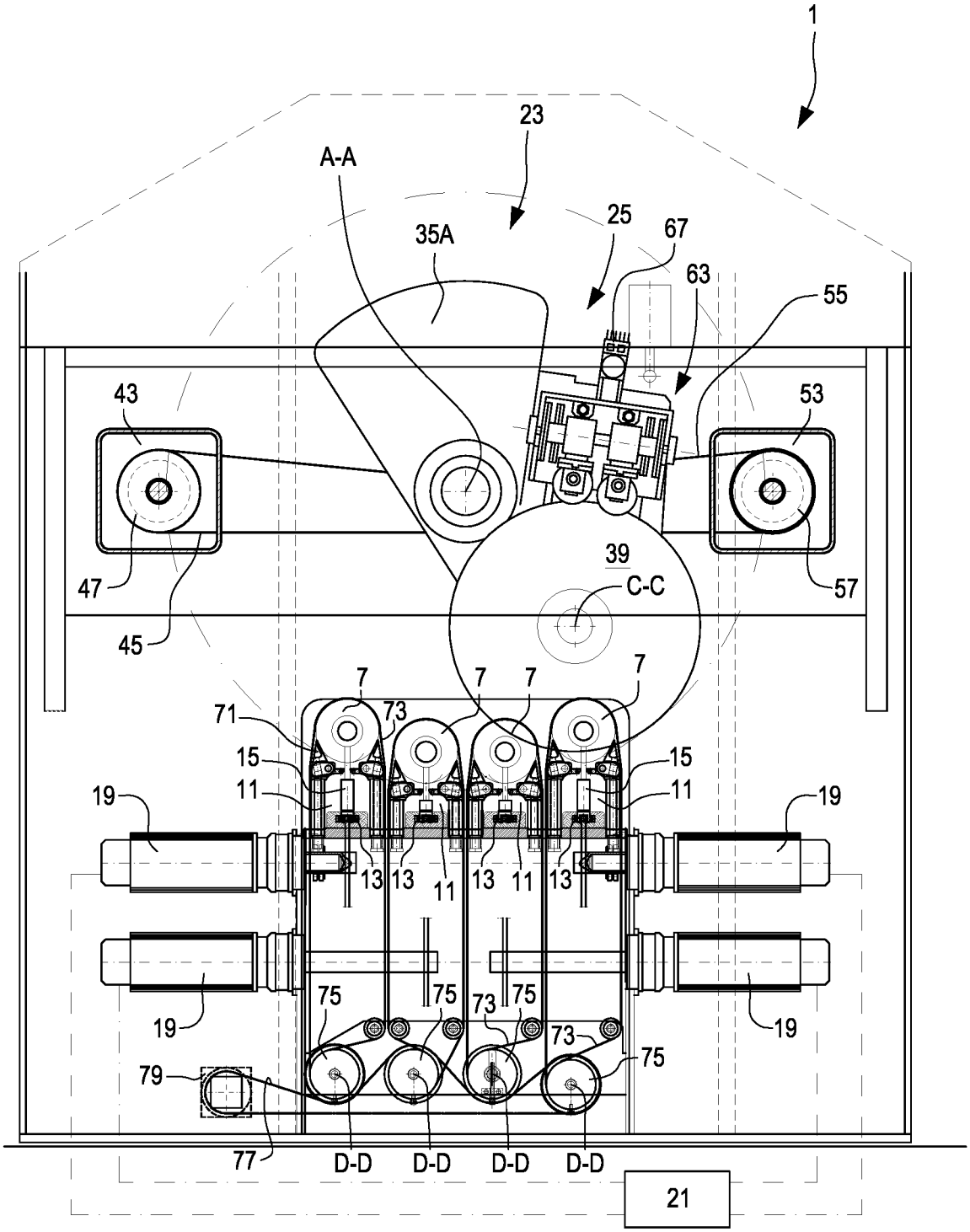
FIG. 3 is view according to III-III of FIG. 1.

In the embodiment illustrated in FIG. 12, a load cell 463 is integral to the casing or support 109, wherein the load cell can be shaped like a small cylindrical bar whose ends are constraint to the case 457 and which extends orthogonally to the rotation axis 103A of the grinding wheel 103. Reference number 465 indicates a connection cable for connecting the load cell 463 to the control unit 21 (FIGS. 2, 3) or to any other system for controlling the instrumentation of the cutting machine 1.

The load cell 463 extends across the sleeve 455 transversally. To this end, the sleeve 455 may have two opposite openings 467, through which the load cell 463 passes. The openings 467 have dimension larger than the cross-section of the load cell 463. For example, if the load cell 463 has a cylindrical cross-section, the openings 467 can be shaped like slots, i.e. they can be elongated in the direction of the rotation axis 103A of the grinding wheel 103. In this way, while the load cell 463 is rigidly connected to the case or support 109, the sleeve 455 can slide with respect to the load cell 463 and to the casing or support 109 in a direction parallel to the rotation axis 103A of the grinding wheel 103.

The sleeve 455 is pushed by the pre-load member 461 to abut against the load cell 463, which applies a reaction force, i.e. a constraint reaction on the sleeve 455. Practically, in the illustrated embodiment, the load cell 463 constitutes a support constraint for the sleeve 455, and applies a thrust F directed in a direction opposite to the pre-load force f143 applied by the pre-load member 143. In the illustrated embodiment, the sleeve 455 has a resting foot 455.1 for resting against the load cell 463.

The load cell 463 is adapted to detect the reaction force F exchanged between the load cell 463 and the sleeve 455. The pre-load member 143 also eliminates the "parasitic" forces that can act on the grinding unit 23 or 25, to which the grinding unit belongs, as the forces due to vibrations.

By assuming that the grinding wheel 103 is still and not touching the disc-shaped cutting blade 37 or 39, the reaction force F measured by means of the load cell 463 will be equal to the pre-load force f143 applied by the pre-load member 143. Vice versa, when the grinding wheel 103 is working, pushed against the disc-shaped cutting blade 37 or 39 by the actuator 65 or 67, the disc-shaped cutting blade 37 or 39 will generate on the grinding wheel 103 a thrust that has a component parallel to the rotation axis 103A and therefore orthogonal to the surface of the flank of the cutting edge 38 of the disc-shaped cutting blade 37 or 38. This component is indicated with S in FIG. 12. When the grinding unit 61 or 63 is moving, other forces can be applied on the grinding unit and, in particular, on the sleeve 455. These forces can be caused, for example, by dynamic forces generated by the movement of the rotating unit 25, on which the disc-shaped cutting blades 37, 39 and the grinding units 61, 63 are mounted. These forces can have components directed according to the rotation axis 103A of the grinding wheel 103, that are algebraically added to the pre-load force f143 and therefore reduce or increase (based on the direction) the reaction force F detected by the load cell 463. Practically, these parasitic forces are negligible thanks to the pre-load applied by the pre-load member 143 on the load cell. The pre-load is therefore useful for stabilizing the whole unit so that, in use, the load cell 463 detects a value of such an order of magnitude to make the undesired components negligible.

As the force f143 is known, and as the force F is known from the signal given by the load cell 463, it is possible to calculate the force S with which the grinding wheel 103 presses against the flank of the cutting edge 38 of the disc-shaped cutting blade 37 or 39.

In this way it is possible to control, for example by means of the central control unit 21, the actuator 65, 67 so that it brings the grinding wheels 101, 103 into the right position for applying the desired force S on the disc-shaped cutting blade 37, 39. The control can be performed in various ways. For example, a feedback system can be provided that, based on the signal detected by means of the load cell 463, corrects any mismatch between the pre-set contact force between grinding wheel and disc-shaped cutting blade and the actual force. The mismatch is corrected by acting on the actuator 65 or 67.

In other embodiments, the control can be done simply by modifying the approach stroke of the grinding wheels moving towards the disc-shaped cutting blade 17. For example, if, with a given approach stroke performed through the thrust actuator 65 or 67, a too high contact force between grinding wheel 103 and disc-shaped cutting blade 37 or 39 is obtained, a smaller approach stroke can be performed at the subsequent cycle. Vice versa, in case of thrust lower than that set, it is possible to increase the approach stroke.

By assuming that the two grinding wheels 101, 103 are symmetrical and correctly set, it is possible to have the result described above by using only one load cell 463, which allows to detect the quantity of the force S of one of the two grinding wheels 101, 103, as it is possible to assume that, due to symmetry, the other grinding wheel 37 or 30 applies an equal force on the disc-shaped cutting blade 37 or 39. It is therefore sufficient to provide each pair of grinding wheels with only one load cell 463.

However, in preferred embodiments two load cells will be provided for each pair of grinding wheels, one for each grinding wheel. In this way it is possible to have more precise measurements and it is possible to take into account any difference in the applied forces due for example to errors in adjusting the position of the grinding wheels 101, 103.

The load cells 463 can be used also, or alternatively to what described above, to detect anomalous fluctuations in the thrust S, that could indicate a malfunction or a damage of the components of the cutting machine 1, for example damages of the disc-shaped cutting blade 37 or 39. It is also possible, when both the grinding wheels 101, 103 are provided with a load cell 463, to detect that they apply the same force on the disc-shaped cutting blade 37 or 39, contrariwise allowing the operator's intervention, for example by adjusting the position of one or the other of the grinding wheels.

Anomalous situations can be signaled through an alarm signal, such as a light signal or an acoustic signal. Alternatively, or in combination, it is possible to display an alarm signal on a display or on a monitor of a computer controlling the cutting machine, or of a control unit. It is also possible to send an alarm or error signal through an application to a mobile phone or other mobile device, with which the staff in charge of the control and surveillance of the machine is equipped.

A signal can be generated also in case malfunctions or anomalous variations of the grinding load, occurring too early with respect to the number of performed cut, are detected. In this case the operator can decide to replace in advance the disc-shaped cutting blade 37 or 39.

If the cutting machine has an automatic system for replacing the disc-shaped cutting blade, the automatic system may replace the disc-shaped cutting blade for example when malfunctions or anomalous variations are detected of the contact force between grinding wheels and disc-shaped cutting blade, for example significant force fluctuations. The automatic replacement can be done also taking into account the number of already performed cuts. System for automatically replacing the disc-shaped cutting blade are disclosed, for example, in WO-A-2016030124.

In some embodiments, the grinding unit with the load cell as described can be also used for automatic resetting the position of the grinding wheels when the disc-shaped cutting blade is replaced. For example, after a new disc-shaped cutting blade has been mounted, the grinding unit can be moved radially towards the new disc-shaped cutting blade detecting, through the respective load cell, the thrust applied by the disc-shaped cutting blade on at least one of the two grinding wheels. When the force detected by the load cell is equal to a set value, for example 1 kg, the position taken by the slide 115 is stored. This is the initial grinding position. At this point, the grinding cycles are performed cyclically moving the grinding unit towards and away from the disc-shaped cutting blade by means of the actuator 65 or 67. The grinding position is corrected as the disc-shaped cutting blade is worn, causing a reduction in the contact force between the grinding wheel and the disc-shaped cutting blade, that can be detected by the load cell.

In other embodiments, the load cell(s) can be used to bring the grinding wheels gradually into the right position with respect to the disc-shaped cutting blade. For example, once the disc-shaped cutting blade has been replaced, at the first grinding cycle it is possible to detect, through the load cells, a thrust greater than that set. In this case, the right position can be gradually achieved, in one or more subsequent grinding cycles, by intervening on the position where the grinding unit is brought at every subsequent grinding cycle. Positioning errors result in thrust values on the springs that do not correspond to the set value. Based on the difference between the set thrust and the detected thrust, subsequent adjustments of the position of the grinding wheels are done.

The configuration of the grinding wheels with load cells described with reference to FIG. 13 can be also used in the grinding unit with four grinding wheels illustrated in FIGS. 9 to 11. In this case load cells can be provided for one or more grinding wheels, if necessary for all the four grinding wheels.

The invention claimed is:

1. A grinding unit for grinding a disc-shaped cutting blade, comprising:

a slide configured to be moved towards and away from the disc-shaped cutting blade;

on said slide, at least a first grinding wheel and a second grinding wheel so arranged as to act on a first flank and on a second flank of a cutting edge of the disc-shaped cutting blade;

wherein the first grinding wheel and the second grinding wheel are respectively carried by a first arm and by a second arm, wherein the first arm and the second arm are mounted so as to rotate around a respective rotation axis with respect to the slide in order to move towards and away from the disc-shaped cutting blade; and wherein the first arm and the second arm are connected to a first angular locking member and a second angular locking member, respectively, wherein the first angular locking member and the second angular locking member are adapted to lock the first arm and the second arm in a respective operative angular position with respect to the slide.

2. The grinding unit of claim 1, wherein the first arm and the second arm and, respectively, the first grinding wheel and the second grinding wheel, are mounted on the slide so that when, respectively, the first arm and the second arm are not locked by the angular locking members, gravity causes a rotation of the first arm and the second arm up to bring respectively the first grinding wheel and the second grinding wheel into contact with a corresponding one of the first flank and the second flank of the cutting edge of the disc-shaped cutting blade.

3. The grinding unit of claim 2, wherein the rotation axis of each of the first arm and the second arm is orthogonal to a plane containing the rotation axis of, respectively, the first grinding wheel and the second grinding wheel.

4. The grinding unit of claim 2, wherein the rotation axis of each of the first arm and the second arm is oriented at 90° with respect to the rotation axis of, respectively, the first grinding wheel and the second grinding wheel and is oriented at 90° with respect to the rotation axis of the disc-shaped cutting blade.

5. The grinding unit of claim 1, comprising a third grinding wheel and a fourth grinding wheel so arranged to act respectively on the first flank and on the second flank of the disc-shaped cutting blade; wherein the third grinding wheel and the fourth grinding wheel are respectively carried by a third arm and by a fourth arm, mounted so as to rotate around the rotation axis of the first arm and of the second arm respectively, in order to move towards and away from the disc-shaped cutting blade; and wherein the third arm and the fourth arm are connected to a third angular locking member and to a fourth angular locking member, respectively, adapted to lock the third arm and the fourth arm, respectively.

6. The grinding unit of claim 5, wherein the first grinding wheel is arranged in front of the second grinding wheel and the third grinding wheel is arranged in front of the fourth grinding wheel.

7. The grinding unit of claim 5, wherein the first grinding wheel and the second grinding wheel are arranged as a first pair of grinding wheels, and the third grinding wheel and the fourth grinding wheel are arranged as a second pair of grinding wheels, and said first pair of grinding wheels is so arranged as to act on the first flank and on the second flank of the disc-shaped cutting blade, has a first grinding feature, and the second pair of grinding wheels has a second grinding feature different than the first grinding feature; and wherein the first grinding feature and the second grinding feature are selected from a group comprising grinding wheel size, grinding wheel hardness, grinding wheel inclination, or a combination thereof.

8. The grinding unit of claim 7, comprising a control unit so programmed as to perform a grinding sequence by using, alternatively or in combination, the first pair of grinding wheels and the second pair of grinding wheels; and wherein the control unit is so programmed as to select a grinding sequence according to at least one features of the product to be cut.

9. The grinding unit of claim 1, wherein the rotation axis of each of the first arm and the second arm is orthogonal to a plane containing the rotation axis of, respectively, the first grinding wheel and the second grinding wheel.

10. The grinding unit of claim 9, wherein the rotation axis of each of the first arm and the second arm is oriented at 90° with respect to the rotation axis of, respectively, the first grinding wheel and the second grinding wheel and is oriented at 90° with respect to the rotation axis of the disc-shaped cutting blade.

11. The grinding unit of claim 1, wherein the rotation axis of each of the first arm and the second arm is oriented at 90° with respect to the rotation axis of, respectively, the first grinding wheel and the second grinding wheel and is oriented at 90° with respect to the rotation axis of the disc-shaped cutting blade.

12. The grinding unit of claim 1, wherein the first arm and the second arm are mounted for rotation on a common support shaft having a longitudinal axis forming a rotation axis of the first arm and of the second arm.

13. The grinding unit of claim 1, wherein the first arm is supported by a first support shaft having a longitudinal axis forming the rotation axis of the first arm; the second arm is supported by a second support shaft having a longitudinal axis forming the rotation axis of the second arm; and wherein the first support shaft and the second support shaft are parallel.

14. The grinding unit of claim 1, wherein the first angular locking member comprises a first angular locking actuator for the first arm and the second angular locking member comprises a second angular locking actuator for the second arm.

15. The grinding unit of claim 1, wherein each of the first arm and the second arm is connected to an angular lifting device adapted to rotate, respectively, the first arm and the second arm against gravity, in a direction opposite to the rotation direction bringing, respectively, the first grinding wheel and the second grinding wheel into contact with the flank of the disc-shaped cutting blade.

16. The grinding unit of claim 1, wherein the first grinding wheel and the second grinding wheel are supported idle and are adapted to be driven into rotation around its rotation axis by friction with the disc-shaped cutting blade.

17. The grinding unit of claim 1, wherein position of the first grinding wheel and the second grinding wheel are adjustable in a direction parallel to the respective rotation axis.

18. The grinding unit of claim 1, wherein the first grinding wheel and the second grinding wheel are associated with a thrust actuator, adapted to move the respective grinding wheel in a direction parallel to the respective rotation axis.

19. The grinding unit of claim 1, wherein the first grinding wheel and the second grinding wheel are arranged, with respect to the disc-shaped cutting blade so that, in a point of contact between the grinding wheel and the disc-shaped cutting blade, speed of the grinding wheel being oriented towards the inside of the disc-shaped cutting blade.

20. The grinding unit of claim 1, wherein a load cell is associated with at least one of said first grinding wheel and said second grinding wheel, the load cell being adapted to detect a thrust correlated with a pressure force between the disc-shaped cutting blade and the at least one of said first grinding wheel and the second grinding wheel.

21. The grinding unit of claim 20, further comprising an actuator adapted to push the first grinding wheel and the second grinding wheel against the cutting edge of the disc-shaped cutting blade, and wherein the actuator is controlled according to a signal that is a function of the thrust detected by the load cell.

22. The grinding unit of claim 20, further comprising a pre-load member for pre-loading the first grinding wheel and/or the second grinding wheel against the load cell.

23. A cutting machine for cutting elongated products, comprising:

at least one disc-shaped cutting blade; and a grinding unit for grinding the at least one disc-shaped cutting blade, comprising a slide configured to be moved towards and away from the disc-shaped cutting blade;

on said slide, at least a first grinding wheel and a second grinding wheel so arranged as to act on a first flank and on a second flank of a cutting edge of the disc-shaped cutting blade;

wherein the first grinding wheel and the second grinding wheel are, respectively, carried by a first arm and by a second arm, wherein the first arm and the second arm are mounted so as to rotate around a respective rotation axis with respect to the slide in order to move towards and away from the disc-shaped cutting blade; and wherein the first arm and the second arm are connected to a first angular locking member and a second angular locking member, respectively, wherein the first angular locking member and the second angular locking member are adapted to lock the first arm and the second arm in a respective operative angular position with respect to the slide.

24. The cutting machine of claim 23, further comprising at least a feed path for products to be cut; wherein the disc-shaped cutting blade and the grinding unit are supported by a unit provided with a cyclic movement for performing subsequent cuts of the products moving forwards along the feed path.

* * * * *